US005191769A

United States Patent [19]

Mangini et al.

[11] Patent Number: 5,191,769

[45] Date of Patent: Mar. 9, 1993

[54] FOOD PREPARATION TABLE HAVING A REFRIGERATED INGREDIENT ZONE

[75] Inventors: Daniel J. Mangini, Turnersville, N.J.; John P. Morris, Broomall, Pa.

[73] Assignee: Glenco-Star, Inc., Philadelphia, Pa.

[21] Appl. No.: 755,860

[22] Filed: Sep. 6, 1991

[51] Int. Cl.[5] ..... F25D 17/06

[52] U.S. Cl. ..... 62/258; 62/418; 165/122

[58] Field of Search ..... 62/258, 418; 34/219, 34/231; 165/122; 454/280, 284

[56] References Cited

U.S. PATENT DOCUMENTS

| | | | |
|---|---|---|---|
| 2,245,234 | 6/1941 | Tanner | 62/418 |
| 2,463,614 | 3/1949 | Hardin | 62/418 X |
| 2,546,417 | 3/1951 | Anglin | 62/418 X |
| 2,555,425 | 6/1951 | Stern | 62/89.5 |
| 2,630,684 | 3/1953 | Strang | 62/418 X |
| 2,677,941 | 5/1954 | Warnick | 62/418 X |
| 2,786,337 | 3/1957 | Spring | 62/89 |
| 2,886,395 | 5/1959 | Cahn | 312/279 |
| 3,056,274 | 10/1962 | Povchert | 62/418 |
| 4,685,311 | 8/1987 | Rastelli | 62/258 |
| 4,782,665 | 11/1988 | Wolfe | 62/246 |
| 4,802,340 | 2/1989 | Johnson | 62/229 |
| 4,856,579 | 8/1989 | Wolfe | 165/48.1 |
| 5,007,249 | 4/1991 | Van Druff, Jr. | 62/418 X |

OTHER PUBLICATIONS

Delfield Catalog, entitled "Compact Refrigerator & Freezer Bases," pp. 1-3, undated.

Silver King Catalog, entitled "Silver King Refrigerated Sandwich Preparation Tables," pp. 1-2, copyright 1988.

Hussman Foodservice Co. Catalog, entitled "Undercounter Salad/Sandwich Top Refrigerators," pp. 1-2, copyright 1988.

*Primary Examiner*—William E. Tapolcai

*Attorney, Agent, or Firm*—Harness, Dickey & Pierce

[57] ABSTRACT

A commercial food preparation refrigerator unit, comprising a food storage chamber disposed under a food preparation table and in which a unique baffle controls circulation of refrigerated air whereby to maintain condiments and/or ingredients in the chamber and foodstuffs in separate trays extending from the table into the chamber, at a uniform refrigerated temperature.

30 Claims, 2 Drawing Sheets

FOOD PREPARATION TABLE HAVING A REFRIGERATED INGREDIENT ZONE

BACKGROUND AND SUMMARY OF THE INVENTION

This invention relates to refrigerator units and food preparation tables where foodstuffs are kept in separate trays for use by the food preparer and served to a customer, and more particularly to an arrangement in such units for circulating cooling air to maintain a low temperature in the food trays.

In commercial fast food establishments certain foods, such as sandwiches, pizza, or salads, are prepared in volume quantities, which requires convenient access by the preparer to ingredients or condiments. These condiments are kept in separate trays for use by the food preparer for assembly into the finished foodstuff. The preparer works at a "make-up" table where the separate ingredients are combined into the finished food product. A typical food preparation table is self-contained, counter top height and formed from thermally insulated stainless steel walls into a generally oblong shaped cabinet. The cabinet includes a refrigeration unit and a chamber for storing and cooling food items. The top wall of the cabinet defines the table, is upwardly open, and has openings for receiving one or more of the foodstuff trays. The trays have their heat transferring bottom and sidewalls extending into the chamber to be cooled by a fan forcing refrigerated air around the bottom portions of the pans. The flow of air and possible loss of velocity head when cooling air must pass long distances may lead to nonuniform chamber cooling and nonuniform cooling of foodstuffs in the tray.

Existing food industry standards set by the National Sanitation Foundation ("NSF") require that a refrigeration unit simultaneously maintain the temperature of food in the tray at 45° F for a prolonged period and with minimum dehydration, and the temperature in the chamber at 40° F. (4° C.) with a maximum of compressor run time of 70 percent in a 100° F. (38° C.) ambient environment, such as found in a pizza restaurant.

NSF has recently established a new and stricter standard that a refrigerated food preparation table be capable of taking a food product at 38° F. and maintaining it for a period of four hours between 33°–40° F. (about 4° C.) in a room where the ambient temperature is 100° F. (about 38° C.). Food preparation tables known in the prior art cannot always keep up with the product heat gain in such environment.

Further, local health codes regulating the operation of food establishments typically require that the temperature of food ingredients be maintained at about 40° F. so that bacteria growth and risk of food poisoning is reduced. Perishable foodstuffs must be maintained at about 40° F. to reduce food spoilage whereas ambient kitchen temperatures can exceed 85° F. (29° C.).

It is a principal object of this invention to provide a self-contained counter top refrigerator unit, operative as a food preparation table, wherein a controlled circulation of refrigerated air maintains both the refrigerator chamber and the condiments and/or ingredients in the separate trays extending into the chamber, at a uniform refrigerated temperature.

Another object of this invention is provision of a uniquely configured baffle plate to simultaneously direct refrigerating air at all of the condiment trays.

Another object of this invention is provision of a horizontal self-contained counter-top upwardly open food preparation table which achieves the above requirements as to control of temperature in a food pan as well as providing cooled air into the foodstuff chamber.

In accordance with this invention there is provided a refrigerated food preparation table including an oblong cabinet forming a horizontal table and having an interior cooling chamber, an arrangement for supporting condiment trays on the table such that the lower portions of the trays are positioned in the chamber, and a refrigeration system including a compressor, a condenser, an evaporator coil to refrigerate air in the cooling chamber, a row of fans to circulate air through the chamber and draw chamber air through the evaporator, and refrigerant coils for passing refrigerant through the components of the refrigeration system for connecting the refrigerator components into a refrigeration cycle.

Further, an insulated compartment is formed in the chamber adjacent to the rear wall thereof for receiving the compressor and condenser, the rear wall being proximate to the compressor for venting heated compressor air, and a partition wall of the compartment separating the evaporator from the other refrigeration equipment. The evaporator coil is supported in the cooling portion of the chamber.

A particularly constructed baffle is mounted in the cooling chamber for directing the flow of refrigerated air within the chamber and about the lower portions of the condiment trays. The baffle extends laterally between the opposite vertical sidewalls of the chamber and includes a first wall which is spaced above the compartment, a second wall which forms a first plenum above the evaporator, and a third wall which cooperates with a flange therefrom to form a second plenum adjacent to the rear wall of the cabinet, the first and third walls being generally vertically extending and the second wall being generally horizontally extending. The first wall is provided with an angled flange to define a suction inlet above the partition wall which supplies recirculated air to the evaporator. The second wall is provided with an array of openings in the form of elongated louvers which ar configured to direct air vertically from the first plenum and primarily against the bottom of the condiment trays. The third wall is provided with an array of generally square openings which are configured to direct air horizontally from the second plenum and primarily against the sidewalls of the trays and into the chamber.

Advantageously, the baffle cooperates with the evaporator and evaporator fans to provide refrigerant air in an amount sufficient to cool yet not freeze food in the condiment tray.

Further, the baffle openings substantially simultaneously provide cooling air both to all of the condiment trays and to the chamber. Proximate location of the baffle openings adjacent to the trays assure uniform heat transfer relation to the foodstuffs in the trays while other cooling air simultaneously is passed directly into the chamber for cooling the stored foodstuffs.

Further, the baffle openings are configured and positioned to direct the cooling air at a desired location such that the desired temperature of the food in the condiment pans is maintained. Efficiency of the baffle correlates into efficiency of the cooling, whereby the refrigerator unit does not have to cycle as frequently, thereby reducing operating costs.

The foregoing and other objects and advantages of this invention will become more apparent when viewed in light of the accompanying drawings and following detailed description of the invention in which:

DETAILED DESCRIPTION OF THE PREFERRED EMBODIMENT

Figure 1:
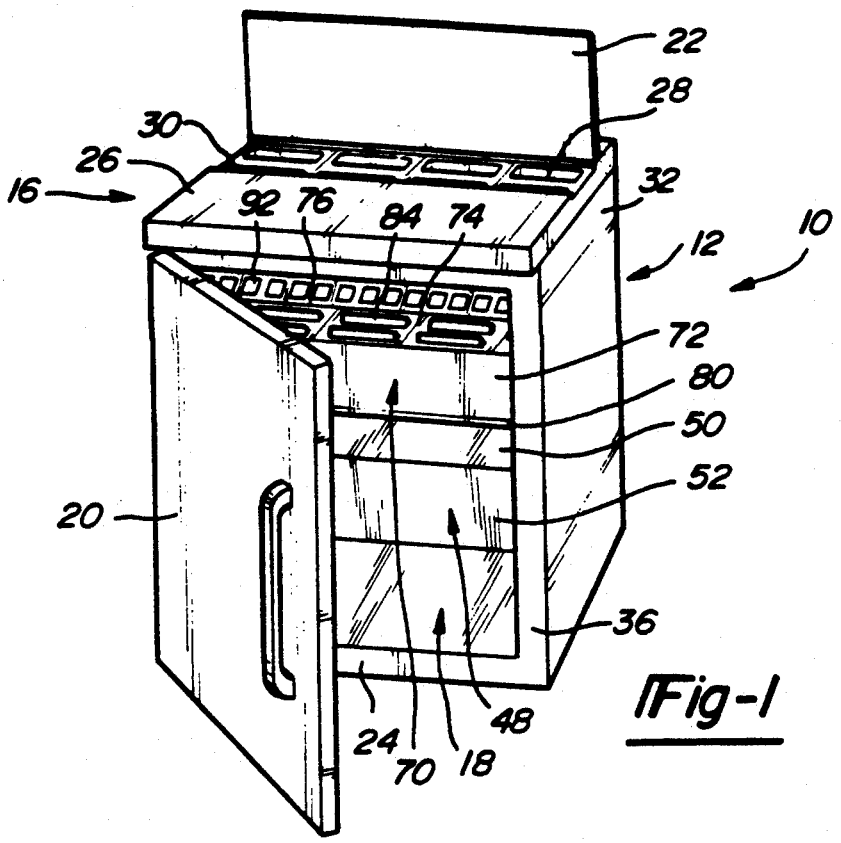
FIG. 1 is a front perspective view of a refrigerator, useful as a food preparation table, embodying the invention.
Figure 2:
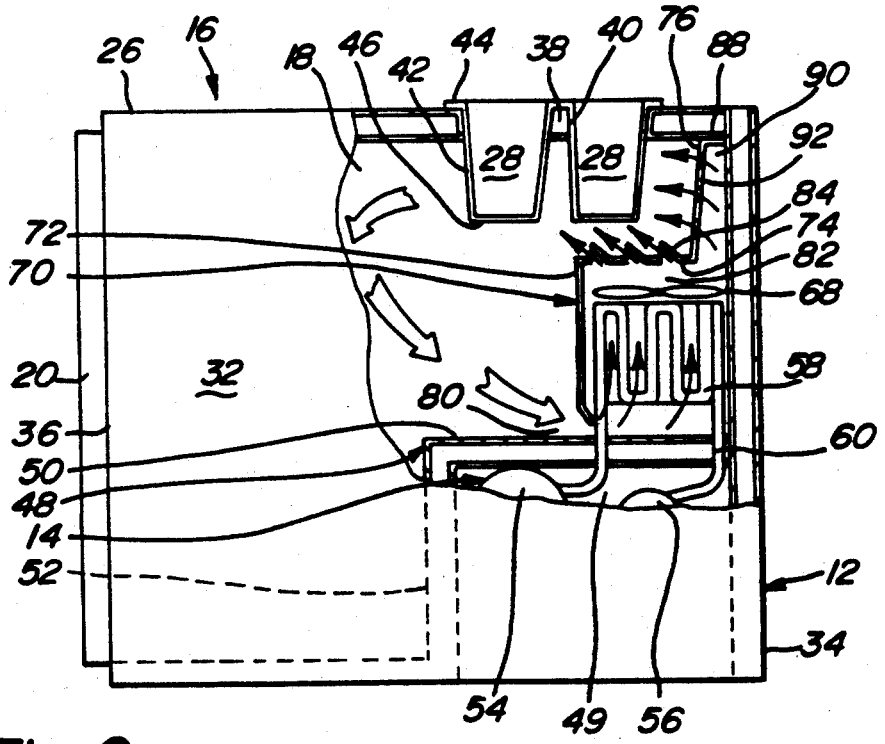
FIG. 2 is a side elevation view in section of the food preparation refrigerator table.
Figure 3:
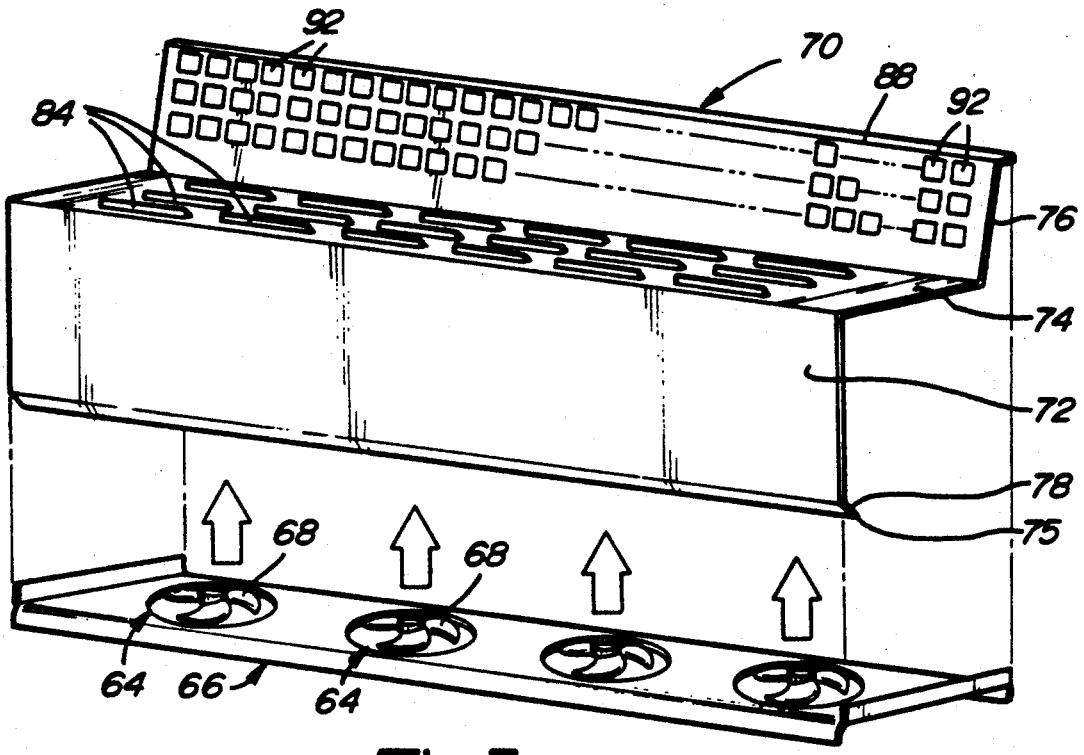
FIG. 3 is a front partial disassembly view in perspective showing an air circulating baffle and evaporator fan support arrangement, according to the present invention.

Turning now to the drawings, FIGS. 1–4 show a food preparation refrigerator table 10 which comprises a generally rectangular cabinet 12 having a refrigeration system 14 integrally operative therewith, the cabinet having a horizontal, counter top height, food preparation area 16, an interior chamber 18 for storing and cooling foods, a door 20 for gaining access to the chamber, and a top lid 22 for covering at least a part of the table top. The cabinet comprises a base 24, an upper table 26 having a support area for supporting a plurality of condiment trays 28 and defining the food preparation area, a pair of sidewalls 30 and 32, a rear end wall 34, and a front wall 36 for supporting the door, the cabinet walls 30, 32, 34 and 36 extending vertically between the base 24 and the table 26 and defining the interior chamber 18. The cabinet walls are thermally insulated, preferably formed of spaced sheets of stainless steel, with the area between the sheets being filled with a suitable thermally insulated material, such as polyurethane, foamed in place.

The table 26 defines a top upwardly open portion of the cabinet and includes a plurality of rails 38 which form openings 40 sized for receiving and supporting one or more upwardly open condiment trays or pans 28 of various sizes useful in storing food to be dispensed. The trays shown are generally rectangular and include four sidewalls 42 each having a lip 44 for supporting the tray on a rail, and a flat base 46, the lower portion of the trays extending into the chamber so as to be maintained in a refrigerated environment. The top lid 22 of the cabinet 12 is adapted to be closed in covering relation with the food in the trays.

A bottom machine compartment 48 is formed in a lower corner of the chamber adjacent to the rear wall 34 thereof and extends laterally between the opposite sidewalls 30 and 32 of the chamber. The compartment includes a horizontal partition wall 50 which is connected to the rear wall 34 of the cabinet, and a vertical partition wall 52 which is connected to the base 24, the opposite ends of the partitions 50 and 52 being connected to the sidewalls 30 and 32 and respective edges of the partitions being adjoined to define a chamber 49 that is sealed from the chamber 18 environment.

The refrigeration system 14 includes a compressor 54, a condenser 56, a condenser fan (not shown), which are enclosed in the chamber 49, and an evaporator coil 58 to cool chamber 18. Copper tubing 60 connects the flow of refrigerant between the compressor, the condenser and the evaporator to effect a refrigeration cycle. While not shown, access to the machine compartment is provided to enable the user to service the refrigeration equipment. Preferably, the lowermost portion of rear wall 34 adjacent to the compartment would include a grille to pass heat generated by the operation of the compressor.

The evaporator coil 58 is supported above the machine compartment so as to have its lower portion 62 spaced vertically above the horizontal partition 50 and its upper portion spaced vertically below a row of evaporator fans 64. A horizontally extending fan support bracket 66 is disposed vertically above the evaporator coil and extends laterally between the sidewalls 30 and 32 of the chamber for connection thereto. Evaporator fans 64 are supported on the support bracket so as to be generally uniformly spaced thereacross and between the sidewalls, the fan blades 68 being positioned directly above the evaporator coil whereby to draw air vertically upwardly therefrom and direct air vertically upwardly. The fan motors (not shown) extend downwardly from the support bracket towards the evaporator.

A thermostat (not shown) is connected to the evaporator coil and is electronically connected to a controller (not shown) for operating the refrigeration system. These elements are not shown as being known in the art. When the temperature of the evaporator falls below a desired temperature, a signal is sent to the controller whereby to operate the compressor and to pump refrigerant through the evaporator coil to provide more cool air.

In accordance with this invention there is provided a baffle 70 for directing air within the refrigerant chamber 18 to assure cooling air is circulated as needed whereby to maintain the food in the condiment pans at a desired temperature. In the embodiment shown, the baffle 70 is integrally formed from a flat sheet of material and sized to extend laterally between the opposite interior sidewalls of the cabinet for connection thereto. The baffle comprises three generally planar walls or plate portions, including a first wall 72, a second wall 74, and a third wall 76. The first wall 72 is generally disposed in a vertical plane, extends vertically upwardly from the machine compartment 48, and has its lowermost edge 75 spaced from the machine compartment. A longitudinally extending marginal end portion of the first wall forms a flange portion 78 that is disposed at approximately 45° to the vertical plane of the wall and terminates in the edge 75. Advantageously, flange portion 78 cooperates with horizontal partition 50 of the machine compartment to form an air suction inlet 80 whereby to supply air from chamber 18 to lower end 62 of the evaporator 58, and a deflector to inhibit possible water formation from the evaporator coils from entering the foodstuff chamber. The row of evaporator fans 64 act to lower the pressure adjacent the lower end portion 62 of the evaporator 58 and thereby draw the air into the inlet 80. The flange portion 78 defines a venturi which increases the velocity of chamber air and thus the velocity of air discharged upwardly to the second and third walls 72 and 74.

Second wall 74 is generally horizontally disposed and is spaced vertically above evaporator coil 58 to define an air plenum 82 directly above the row of evaporator fans. Second wall 74 is proximate the base surfaces 46 of the condiment trays 28 and is provided with a plurality of longitudinally extending, axial, rectangular-shaped openings 84 which direct cooled air from the evaporator fans vertically towards the condiment pans. Preferably, the openings 84 are shown as comprising a plurality of louvers, arranged on a rectangular grid, which result from the sheet material forming the second wall being stamped or formed from any conventional process. Although the louvers are shown extending only in a direction upwardly from the sheet material, it is to be understood that the forming process could result in the louvers being directed only inwardly of the sheet and towards the fans, or directed in both directions from the sheet. The louvers include a sheet portion 86 which is at an acute angle to the plane of the sheet whereby to desirably direct the air without diminishing or diffusing the velocity head.

Third wall 76 is generally vertically disposed and extends vertically upwardly from second wall 74 at approximately 10°–15° to a vertical plane. A horizontally disposed flange portion 88 extends from the third wall as a continuation thereof for connection to the interior rear wall 34 of the cabinet. Desirably, flange portion 88 spaces third wall 76 from the rear wall 34 of the cabinet whereby to define a vertical air plenum 90 therebetween. The third wall is proximate the sidewalls 42 of the condiment trays 28 and is desirably formed to include a plurality of generally square-shaped openings 92 which direct cooled air directly from the plenum 90 and against the trays.

Preferably in accordance with one embodiment of this invention, support bracket 66 is about 34 inches by 5 inches (170 sq. inches) and supports four fans 64 about 2.5 inches below second wall 74 to draw air vertically from evaporator coil 58 and force cool air into the two plenums 82 and 90 thereabove. The fans are longitudinally aligned in a row across the bracket, each fan having a blade diameter of about 4.5 inches and a motor capable of delivering an output of about 460 cfm.

Second wall 74 is about 40.75 inches by 3.43 inches (140 sq. inches) and centered in parallel relation above support bracket 66. A patch of 21 louvers 84 are disposed on a rectangular grid (7 longitudinally spaced in side by side relation and 3 deep). Each louver extends upwardly from second wall at about 25°–40° thereto with a preferred angle being about 30°. Each louver defines a generally rectangular opening having a long dimension that is about 4 inches long and a short dimension that is about 0.1875 inch wide, for an opening area of about 0.75 sq. inches (total flow area of 15.75 sq. in.). The bottom edge 75 is about 0.5 inch from machine compartment wall 50 to define the air suction inlet.

Third wall is about 40.75 inches by 3.62 inches (147.7 sq. inches) and includes an array of 135 openings 92 that are disposed on a rectangular grid (45 longitudinally spaced in side by side relation and 3 deep). Each opening 92 is generally square and has an area of 0.25 sq. inches (total flow area of 33.75 sq. in.).

The total area for passing air through the openings 92 in third wall 76 is approximately twice the area defined through the louvers 84 in second wall 74. The total velocity head of refrigerant air is about 350–400 ft./min. with 350 ft./min. being preferred in the embodiment shown.

In operation, the thermostat control "reads" the evaporator temperature and sends a signal to a controller of the refrigeration system, whereby the coolant is driven through the evaporator and the four fans are driven to draw new cooled air vertically from the suction inlet and direct air at the inwardmost portions of the condiment trays. The baffle orientation relative to the pans causes a constant "blast" of chamber air to be directed at and about the pans. The recirculation path also serves to maintain foodstuffs stored in the chamber in a refrigerated state.

Figure 4:
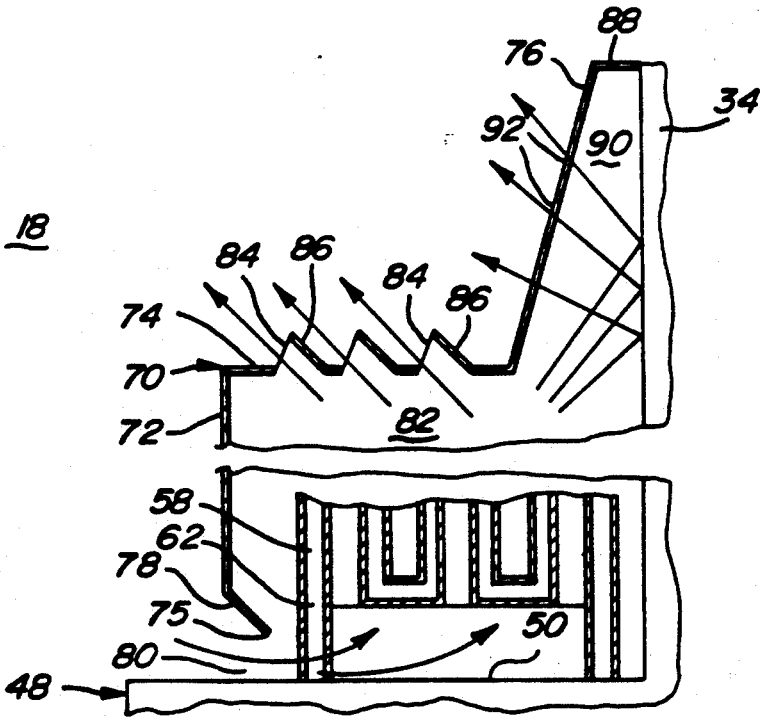
FIG. 4 is a side view taken along line 4—4 of FIG. 3 of the air circulating baffle.

As particularly is shown in reference to FIG. 4, the air is caused not only to recirculate but substantially simultaneously provide cool air to the chamber and against all of the sidewalls and bottom walls of trays. It is believed that the configuration of second wall 74 relative to rear wall 34 increases the pressure in plenum 90 such that both direct and reflected velocity air is directed through openings 92. As such, cool air is simultaneously passed between each of the side by side trays, whereby to cool one sidewall directly and two sidewalls indirectly as the air is passed directly into the chamber to cool the foodstuffs therein.

Thus, there is disclosed in the above-description and in the drawings and embodiment of the invention which fully and effectively accomplishes the objects thereof. However, it will be apparent to one skilled in the art that variations in the details of the apparatus may be indulged in without departing from the invention herein described, or the scope of the appended claims.

What is claimed is:

1. In a horizontal self-contained counter top height food preparation table, a cabinet having a chamber for storing foods and an elongated horizontally extending top surface exposed to ambient temperatures, an evaporator coil in said chamber for cooling the air in said chamber, a plurality of respective condiment pans useful in storing foods to be dispensed to the public supported on said top surface so as to be upwardly open and having bottom portions disposed in said chamber, and flow directing means for directing and circulating refrigerated air at said bottom portions to maintain foodstuffs in the condiment pans at a uniform refrigerated temperature, the improvement wherein said flow directing means comprises a first, second and third plate disposed in covering relation to said evaporator coil, said first plate extending generally horizontally adjacent the bottom of said pans and formed to include a plurality of first openings to direct air generally vertically, said second and third plates being adjoined to said first plate along respective longitudinal edges and extending generally vertically, said second plate being formed to include a plurality of second openings to direct air generally horizontally, and said third plate having a lowermost longitudinal edge spaced vertically from the bottom of said chamber whereby to define a path to supply air to the evaporator coil, and fan means to move air through said evaporator coil and direct the air directly against each of said first and second plates and into said openings, said openings directing air substantially simultaneously at all of said bottom portions and into said chamber.

2. The improvement as claimed in claim 1 wherein the total area defined by one said plurality of openings is approximately twice the total area defined by the other said plurality of openings.

3. The improvement as claimed in claim 1 wherein said second plate is disposed at an acute angle to a vertical plane.

4. The improvement as claimed in claim 1 wherein said plates have opposite lateral ends connected to the interior wall of said chamber to define, respectively, a first and second plenum proximate to said evaporator coil.

5. In a refrigerated appliance for cooling foodstuffs, an enclosure having an insulated chamber for storing foodstuffs, and refrigerator means including a fan for supplying and moving cooling air to maintain a refrigerated environment in said chamber for cooling the foodstuffs stored therein, said enclosure having a generally horizontally disposed top wall provided with one or more spaced openings communicating with said chamber, and said openings being adapted for receiving and spacing heat transferring bottom and sidewall surfaces of foodstuff containers extending vertically downwardly from said top wall and inwardly of the chamber, the improvement comprising baffle means disposed in close proximity to said top wall for substantially simultaneously directing said cooling air from said refrigerator into said chamber and against the heat transferring bottom and sidewall surfaces of said containers, said baffle means including a horizontally disposed first baffle plate having a plurality of first outlet openings confronting the heat transferring surfaces of said containers and configured to direct said cooling air generally vertically, and a vertically disposed second baffle plate connected to said first baffle plate, said second baffle plate having a plurality of second outlet openings confronting the heat transferring surfaces of said containers and configured to direct said cooling air generally horizontally and in a direction transverse to the air from said first outlet openings, said cooling air being substantially simultaneously directed by said fan directly against each said baffle plate and directly into the chamber against said heat transferring surfaces.

6. The improvement as claimed in claim 5 wherein said chamber has an interior defined by a pair of opposing sidewalls, a rear wall, a front wall opposing said rear wall, and a bottom wall, each said first and second baffle plate has opposite lateral end portions connected to the sidewalls of said chamber, said first baffle plate being proximate to the top wall whereby said first outlets direct said cooling air directly towards the bottom surfaces of said containers, and said second baffle plate being proximate to the rear wall of said chamber whereby said second outlets direct said cooling air directly towards the sidewall surfaces of said containers.

7. The improvement as claimed in claim 5 wherein each said baffle plate is generally planar, and said first and second outlet openings are disposed in side by side relation and along the lines of a respective rectangular grid.

8. The improvement as claimed in claim 5 wherein said first outlet openings comprise generally rectangular slots each having a long dimension and a short dimension, the long dimensions being disposed in s id first direction.

9. The improvement as claimed in claim 5 wherein the second outlet openings are generally square in shape.

10. The improvement as claimed in claim 5 wherein the total area defined by said first outlet openings in said first baffle plate is less than the total area defined by the second outlet openings in said second baffle plate.

11. The improvement as claimed in claim 5 wherein the total area defined by said second outlet openings is approximately twice the total area defined by said first outlet openings.

12. The improvement as claimed in claim 7 wherein said first outlet openings comprise a grid formed by at least three parallel rows of six rectangular slots aligned with and extending in the first direction.

13. The improvement as claimed in claim 7 wherein said second outlet openings comprise a grid formed by at least three parallel rows of 40 openings aligned with and extending in the first direction.

14. The improvement as claimed in claim 5 wherein said first outlet openings comprise louvers stamped from said first baffle plate, each said louver including an elongated portion extending from the plan of said first baffle plate.

15. The improvement as claimed in claim 14 wherein the elongated portion of each said louver extends in said first direction and is disposed at an acute angle to said plate.

16. The improvement as claimed in claim 14 wherein the extended portions extend from the plate in a direction towards said top wall.

17. The improvement as claimed in claim 15 wherein the acute angle is about 28°-35° to the plane of said baffle plate.

18. The improvement as claimed in claim 15 wherein the acute angle is about 30° to the plane of said baffle plate.

19. The improvement as claimed in claim 5 wherein said refrigeration unit includes a condenser, a compressor, an evaporator, and means for connecting said refrigeration components into the relation of a refrigeration cycle, compartment means for receiving and insulating said compressor and condenser from said chamber, support means for supporting said evaporator coil in said chamber and separating said evaporator from said compressor and said condenser, and fan means for circulating air in said chamber and providing a flow of chamber air into and from the evaporator.

20. The improvement as claimed in claim 5 wherein said baffle means includes a third plate extending between the sidewalls of said chamber, said second baffle plate being vertically disposed and connected to said first baffle plate whereby to form a stepped configuration, and said refrigerator means includes an evaporator coil enclosed by said baffle plates and said fan is disposed above an uppermost portion of said evaporator and proximate said first and second baffle plates.

21. The improvement as claimed in claim 20 wherein said third baffle plate includes a lower edge portion extending in said first direction and proximate to said bottom wall to define a suction inlet adjacent to the lower portion of the evaporator coil.

22. The improvement as claimed in claim 20 including first connecting means for spacing and connecting said second baffle plate to the rear wall of said chamber and to be proximate to said top wall, and second connection means for connecting the opposite ends of said first, second and third baffle plates to the sidewalls of said chamber whereby to define interconnected first and second air plenums above said fan means and proximate to said first and second outlet openings.

23. A baffle for use in a refrigerated food preparation table, the table including a refrigerated chamber, a work surface for supporting foodstuff containers into the chamber, and a fan for moving refrigerated air in the chamber, the baffle being removably mountable in said chamber and comprising an L-shaped sheet member sized to extend laterally between and connect to opposite sidewalls of the chamber. said baffle including a planar first sheet formed to include a plurality of first openings to direct air in a first direction towards the containers, a planar second sheet extending in said first direction and formed to include a plurality of second openings to direct air in a second direction transverse to said first direction and towards the containers, and a third sheet extending from said first sheet in a direction opposite to said first direction.

24. The baffle as claimed in claim 23 wherein said first openings are defined by louvers which extend from the plane of said first sheet.

25. The baffle as claimed in claim 23 wherein each said first opening defines a first area, and each said second opening defines a second area, the sum of said first areas being about twice the sum of said second areas.

26. The baffle as claimed in claim 24 wherein each said louver defines a generally rectangularly-shaped opening, the area of each said first opening being greater than the area of each said second opening.

27. A refrigerator unit for storing and cooling foodstuffs, said unit comprising:

an evaporator for cooling the air in said unit, fan means for driving the cooled air in a first direction, a container upwardly open to ambient air for receiving foodstuffs to be cooled and having outer surfaces extending into said unit whereby to be in heat transfer relation with the cooled air, and baffle means spaced from the container for dividing the cooled moving air into first and second portions and directing the divided air portions directly at said outer surfaces.

28. An apparatus for cooling and directing cooled air, said apparatus comprising:

cooling means, including an evaporator coil having cooling fins, for cooling air presented to said fins;

fan means for moving said air through said cooling fins whereby to cool said air; and baffle plate means, disposed about said cooling fins, for dividing and directing the cooled air into first and second portions moving, respectively, along first and second paths that are substantially orthogonal to one another, said baffle plate means including a first plate portion adapted to direct the first portion of the cooled moving air only along said first path, and a second plate portion connected to the first plate and adapted to direct the second portion of the cooled moving air only along said second path, said fan means being positioned to direct the air directly at each said plate portion .

29. The apparatus as claimed in claim 28 wherein said first plate portion is spaced a first distance from said fan means, and said second plate is spaced a second distance from said fan means, said second distance being greater than said first distance.

30. The apparatus as claimed in claim 28 wherein said fan means and one of said plate portions directs the air in a first direction, and the other of said plate portions directs the air in a second direction generally orthogonal to said one plate portion.

* * * * *